United States Patent [19]

Webb et al.

[11] Patent Number: 4,527,856

[45] Date of Patent: Jul. 9, 1985

[54] MODULAR TELEPHONE JACK

[75] Inventors: Michael J. Webb; David W. Johnson, both of London, Canada

[73] Assignee: Northern Telecom Limited, Montreal, Canada

[21] Appl. No.: 450,114

[22] Filed: Dec. 15, 1982

[51] Int. Cl.[3] ..... H01R 13/50

[52] U.S. Cl. ..... 339/206 R; 339/176 M

[58] Field of Search ..... 339/17 C, 17 LC, 91 R, 339/125 R, 126 R, 176 M, 176 MP, 207 R, 206 R, 206 P, 208

[56] References Cited

U.S. PATENT DOCUMENTS

| | | | |
|---|---|---|---|
| 3,369,214 | 2/1968 | Krumreich et al. | 339/105 |
| 3,850,497 | 11/1974 | Krumreich et al. | 339/126 R |
| 3,874,762 | 4/1975 | Shott et al. | 339/91 R |
| 4,108,526 | 8/1978 | McKee | 339/206 R |
| 4,146,292 | 3/1979 | Garrett | 339/125 R |
| 4,202,593 | 5/1980 | Abernethy et al. | 339/125 R |
| 4,221,458 | 9/1980 | Hughes | 339/176 MP |
| 4,239,316 | 12/1980 | Spaulding | 339/126 R X |
| 4,273,402 | 6/1981 | Hughes | 339/91 R |
| 4,274,691 | 6/1981 | Abernethy et al. | 339/126 R |
| 4,397,513 | 8/1983 | Clark et al. | 339/91 R |
| 4,438,998 | 3/1984 | Myers | 339/176 M X |
| 7,961,003 | 8/1977 | Krumreich | 336/176 M |

FOREIGN PATENT DOCUMENTS

| | | | |
|---|---|---|---|
| 2909616 | 9/1980 | Fed. Rep. of Germany | 339/91 R |

*Primary Examiner*—William R. Briggs

*Attorney, Agent, or Firm*—Sidney T. Jelly

[57] ABSTRACT

A modular telephone jack has two parts, top and bottom, which assemble together by relative vertical movement. Flexible members extending down from the main body of the top part pass down over the sides of the bottom part. Inwardly projecting ribs on the flexible members snap over outwardly projecting ribs on the sides of the bottom part. A jack with the minimal vertical profile is provided and enclosing shrouds and sonic welding of joints are avoided.

6 Claims, 8 Drawing Figures

MODULAR TELEPHONE JACK

This invention relates to a two-part modular telephone jack, and particularly to a snap-action assembly of the two parts.

Modular jacks conventionally are formed from two parts, top and bottom. The two parts cooperate to define an aperture. The bottom part usually defines the bottom and sides of the aperture, the top part forming the top of the aperture. The lower part of the aperture is profiled to locate a plug and to ensure correct orientation of the plug when inserted into the jack. The top part carries spring contacts which make contact with contacts in the plug, conductors being connected to the contacts.

One way of making jacks is to sonic weld the two parts together. This is not particularly satisfactory in that it is not possible to determine the quality of the join, which can vary from assembly to assembly. In fact, the only way to be 100 percent certain of the quality of the joins is to submit each jack to a specified tensile weld test. However this approach is of course useless as every jack is then destroyed or substantially weakened. The situation is therefore somewhat unsatisfactory.

Another way of assembling two parts of a jack is to form the bottom part with a shroud which extends over the top part to capture and locate the top part, the top part being slid horizontally over the bottom part into the shroud. Deformable detents engage into recesses to provide a snap assembly which holds the two parts in alignment once assembled. If the direction of insertion of a plug into the jack is considered as axial or lateral direction, then the sliding of the top part relative to the bottom part is in this axial or lateral direction. Relative vertical movement between the two parts is prevented by the shroud.

The present invention avoids the need for a shroud and provides assembly by relative vertical movement between top and bottom parts. This provides a jack with the minimum vertical profile, that is a lower overall height. The current trend in telephone set design is towards miniaturization and consequently the available space in either the handset or the set base has been severely reduced. The ability to provide a jack in which the two parts are positively assembled without a shroud or relying on sonic welding is a very distinct advantage.

The present invention provides a modular jack having top and bottom parts, the parts assembled by relative vertical movement, vertically extending flexible snap members on one member deflecting over and snapping in behind ramps on the other member. Guide surfaces on the member having the ramps provide lateral location and guidance during assembly.

The invention will be readily understood by the following description of an embodiment, by way of example, in conjunction with the accompanying drawings, in which.

Figure 1:
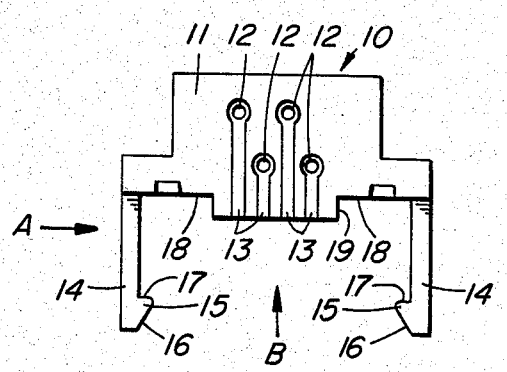
FIG. 1 is a front view of a top part of a jack.
Figure 2:
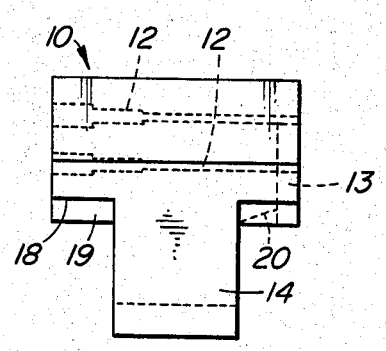
FIG. 2 is a side view in the direction of the arrow A in FIG. 1.
Figure 3:
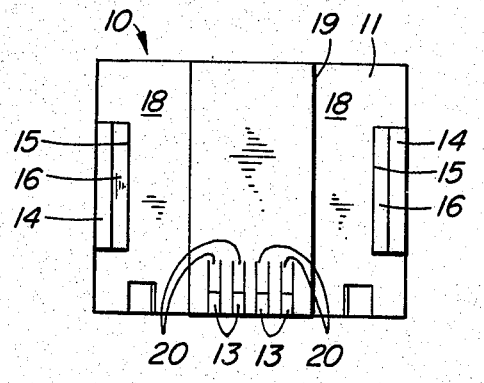
FIG. 3 is a bottom view in the direction of the arrow B in FIG. 1.

Considering FIGS. 1, 2 and 3 the top 10 comprises a main body portion 11. A plurality of bores 12 extend longitudinally through the body portion, the bores connecting with grooves 13 extending down the front face. At either side of the main body portion are downwardly extending flexible snap members 14, having inwardly extending ribs 15. The ribs 15 each have a downwardly and outwardly extending lower surface 16, and a horizontal upper surface 17. In the example, the snap members 14 are centrally placed on the body member, and of slightly reduced length longitudinally compared to the body member, as can be seen in FIG. 2.

The bottom surface 18 of the body member has a wide central web 19 extending downward a short distance between the members 14, the central web 19 having a flat bottom surface. Short inclined grooves 20 extend from the grooves 13 at the front face.

Figure 4:
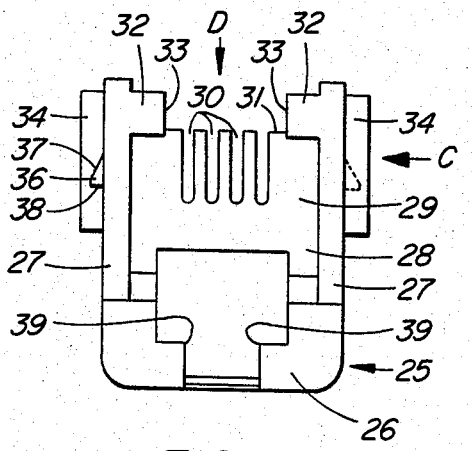
FIG. 4 is a front view of a bottom part of a jack.
Figure 5:
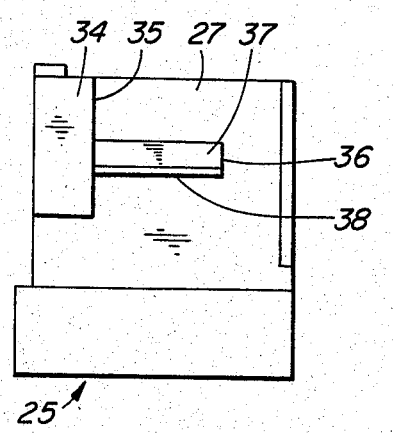
FIG. 5 is a side view in the direction of the arrow C in FIG. 4.
Figure 6:
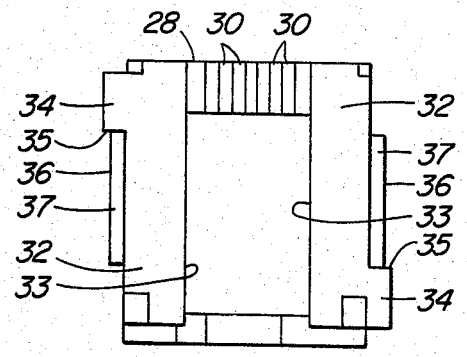
FIG. 6 is a top view in the direction of the arrow D in FIG. 4.

FIGS. 4, 5 and 6 illustrate the bottom part 25. The bottom part 25 is generally of a U-shaped configuration having a base web 26 and side webs 27, side webs 27 being spaced apart laterally and parallel. Extending between the side webs 27 at one end, a back end, of the bottom part is a comb member 28, in the form of a web 29 having a plurality of parallel slots 30 extending down from a top edge 31.

The top edges of the side webs 27 have inwardly projecting ribs 32, the distance between the opposing faces 33 of the ribs being such that the central web 17 of the top part is a sliding fit between the faces 33.

On the outside of the side webs 27 are formed guide members 34. The guide members are formed one at the rear end of one side member 27 and the other at the front end of the other side member. The guide members 34 each have a guide surface 35, the guide surfaces facing towards the transverse center line or axis of the bottom member.

Also formed on the outside of the side webs 27 are outwardly extending ribs 36, a rib on each side member. Each rib 36 has an outwardly and downwardly inclined top surface 37 and a bottom surface 38 which is normal to the web 27.

The base web 26 of the bottom part has a configuration or profile at 39, to match the external profile of a plug.

Figure 7:
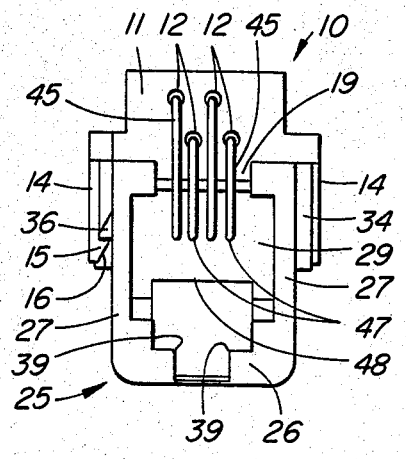
FIGS. 7 and 8 are front and side views of an assembled jack.
Figure 8:
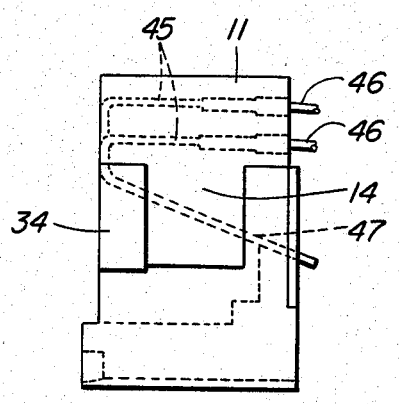

FIGS. 7 and 8 illustrate an assembled jack. The top member is pushed down on to the bottom member 25. The guide surfaces 35 on the bottom member locate this top member longitudinally. The side webs 14 of the top member pass down outside the side webs 27 of the bottom part, the ribs 15 finally riding over the ribs 36 and snapping in under the ribs, surfaces 17 and 38 in contact. The central web 18 slides between the inner faces 33 of the ribs 32 on the bottom part, the surface 17 of the top part contacting the top surface of the bottom part.

Prior to assembly of the top part to the bottom part, spring contact members 45 are inserted into the top member. The spring contact members are attached to conductors 46 and are originally straight. The contact members are inserted through the bores 12 from the back face, the contact members then bent down to lie in the grooves 13, and then the free ends 47 bent rearwards. In assembly of the top portion to the bottom portion, the free ends 47 are positioned in the slots 30 of the comb member 29.

By assembling the two parts with a relative vertical movement, a jack of considerably reduced height is obtained as compared to a two part snap assembled jack in which the parts are assembled by relative longitudinal movement. No shroud around the top part is required. This reduced height is of particular relevance when used in telephones having a low profile. Low profiles are becoming very prevalent in present day telephones, with the reduction in size of components. This is particularly evident for electronic telephones when the telephone set base can be very low, creating problems in providing sufficient height for a jack. The invention provides a low height jack and also avoids the problems of parts being sonic welded.

The two parts define the conventional aperture 48 for receiving the conventional modular plug. The terms top part, bottom part, longitudinal, lateral and vertical have been used in relation to the illustration of the jack in the drawings. In actual use the orientation of the jack may vary.

What is claimed is:

1. A modular telephone jack having top and bottom parts defining an aperture for a modular plug, said top part comprising;

a main body member, a plurality of bores extending longitudinally therethrough, and a plurality of grooves extending down a front face thereof, said grooves connected to said bores, a groove connected to each bore; a conductor extending through each bore, each conductor connected to a spring contact member, the contact members extending down in said grooves, and back into said aperture; a flexible member extending down at each side of the main body member and below a bottom surface of the main body member; an inwardly extending rib at a bottom end of each flexible member, each rib having a downwardly and outwardly extending lower surface; and a guide and locating surface extending down at least one side of each flexible member;

said bottom part comprising; a base web; two parallel spaced apart side webs extending up from said base web; a guide member extending up each side web on an outer surface thereof, each guide member including a guide and locating surface on one side thereof, the guide and locating surfaces facing toward a central axis of said bottom part; an outwardly extending rib extending laterally on each side web, for engagement by said inwardly extending ribs on said flexible members; and a comb member extending between said spaced apart side webs at a back end of said bottom part, said comb member comprising a web having a plurality of parallel sided slots extending down from a top edge thereof, a slot for each said groove on said main body member, said slots positioned to align with said grooves.

2. A jack as claimed in claim 1, said top part including a central web extending beyond said grooves, said grooves extending down a front face of said central web; said spaced apart side webs each having an inwardly projecting rib at an upper end thereof, inner surfaces of said inwardly projecting ribs opposed and parallel and spaced apart to receive said central web in a sliding fit.

3. A jack as claimed in claim 1 said guide members on said side webs comprising a first member extending up one side member at a forward end thereof and a second member extending up the other side member at a rear end thereof, said outwardly extending ribs on said side webs comprising a first rib extending rearwardly from said first member extending up said one side member and a second rib extending forwardly from said second member extending up said other side member.

4. A jack as claimed in claim 1, including spring contact members in said top part, a contact member in each bore and connected to a conductor extending from said top part, said contact members extending down said grooves and rearward beneath said main body member.

5. A jack as claimed in claim 4, said top part assembled to said bottom part, said inwardly extending ribs on said flexible members snapped over said outwardly extending ribs on said side webs, said top part located relative to said bottom part by engagement between said guide and locating surfaces on the flexible members and on the guide members, said spring contact members extending through said slots in said comb member.

6. A jack as claimed in claim 1, said outwardly extending ribs on said side webs each having a downwardly and outwardly inclined top surface and a bottom surface extending normal to the side web, each of said inwardly extending ribs on said flexible members each having a top surface extending normal to the flexible member.

* * * * *